US011374296B2

(12) United States Patent
Darling

(10) Patent No.: US 11,374,296 B2
(45) **Date of Patent: *Jun. 28, 2022**

(54) CERAMIC FILTER USING STEPPED IMPEDANCE RESONATORS HAVING AN INNER CAVITY WITH A DECREASING INNER DIAMETER PROVIDED BY A PLURALITY OF TAPERS

(71) Applicant: Skyworks Solutions, Inc., Irvine, CA (US)

(72) Inventor: John Kenneth Darling, New Market, MD (US)

(73) Assignee: Skyworks Solutions, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/867,933

(22) Filed: May 6, 2020

(65) Prior Publication Data

US 2020/0373643 A1 Nov. 26, 2020

Related U.S. Application Data

(63) Continuation of application No. 15/906,320, filed on Feb. 27, 2018, now Pat. No. 10,658,721, which is a continuation of application No. 14/803,684, filed on Jul. 20, 2015, now Pat. No. 9,941,563.

(60) Provisional application No. 62/057,659, filed on Sep. 30, 2014.

(51) Int. Cl.
*H01P 1/205* (2006.01)
*H01P 7/04* (2006.01)

(52) U.S. Cl.
CPC ..... *H01P 1/2053* (2013.01); *H01P 1/2056* (2013.01); *H01P 7/04* (2013.01)

(58) Field of Classification Search
CPC ..... H01P 1/2053; H01P 1/2056; H01P 7/04
USPC ..... 333/206, 222
See application file for complete search history.

(56) References Cited

U.S. PATENT DOCUMENTS

| | | | |
|---|---|---|---|
| 4,985,690 | A | 1/1991 | Eguchi et al. |
| 5,124,676 | A | 6/1992 | Ueno |
| 5,144,268 | A | 9/1992 | Weidman |
| 5,818,312 | A | 10/1998 | Noguchi et al. |
| 5,850,168 | A | 12/1998 | McVeety |
| 5,867,076 | A | 2/1999 | Taka et al. |

(Continued)

FOREIGN PATENT DOCUMENTS

| | | |
|---|---|---|
| CN | 1163678 | 10/1997 |
| CN | 102522617 | 6/2012 |

(Continued)

OTHER PUBLICATIONS

M. Sagawa et al. "Geometrical Structures and Fundamental Characteristics of Microwave Stepped-Impedance Resonators", IEEE Trans. Microwave Theory and Techniques, vol. 45, No. 7, 1997, pp. 1078-1085.

*Primary Examiner* — Benny T Lee
(74) *Attorney, Agent, or Firm* — Knobbe, Martens, Olson & Bear, LLP

(57) ABSTRACT

Disclosed are embodiments of ceramic radiofrequency filters advantageous as RF components. The ceramic filters can include a ceramic stepped impedance resonator, wherein the inner diameter of the ceramic stepped impedance resonator can vary from one end to another end. The inner diameter can be, for example, tapered, sectioned, or stair-stepped in order to provide different impedances in the ceramic resonator.

20 Claims, 7 Drawing Sheets

(56) References Cited

U.S. PATENT DOCUMENTS

| | | | |
|---|---|---|---|
| 5,929,726 | A | 7/1999 | Ito et al. |
| 6,150,905 | A | 11/2000 | Nishijima |
| 6,184,759 | B1 | 2/2001 | Yorita |
| 6,255,917 | B1 | 7/2001 | Scott |
| 6,281,764 | B1 | 8/2001 | Arakawa et al. |
| 6,833,773 | B1 | 12/2004 | Tsukamoto et al. |
| 7,388,457 | B2 | 6/2008 | Pance et al. |
| 9,941,563 | B2 | 4/2018 | Darling |
| 10,658,721 | B2 | 5/2020 | Darling |

FOREIGN PATENT DOCUMENTS

| | | |
|---|---|---|
| JP | S35-11962 | 8/1960 |
| JP | S57-125002 | 8/1982 |
| JP | H02-260902 | 10/1990 |
| JP | H04-200102 | 7/1992 |
| JP | H09-8505 | 1/1997 |
| JP | H09-232824 | 9/1997 |
| KR | 100756220 B1 | 9/2007 |

CERAMIC FILTER USING STEPPED IMPEDANCE RESONATORS HAVING AN INNER CAVITY WITH A DECREASING INNER DIAMETER PROVIDED BY A PLURALITY OF TAPERS

INCORPORATION BY REFERENCE TO ANY PRIORITY APPLICATIONS

This Application is a continuation of U.S. patent application Ser. No. 15/906,320, filed Feb. 27, 2018, titled "CERAMIC FILTERS USING STEPPED IMPEDANCE RESONATORS HAVING AN INNER CAVITY WITH AT LEAST ONE STEP AND AT LEAST ONE TAPER," issued on May 19, 2020 as U.S. Pat. No. 10,658,721, which is a continuation of U.S. patent application Ser. No. 14/803,684, filed Jul. 20, 2015, titled "STEPPED IMPEDANCE RESONATOR FILTERS AND THEIR USES", issued on Apr. 10, 2018 as U.S. Pat. No. 9,941,563, which claims from the benefit of U.S. Provisional Application No. 62/057,659, filed Sep. 30, 2014, titled "STEPPED IMPEDANCE RESONATOR FILTERS AND THEIR USES," the entirety of each of which is incorporated herein by reference.

BACKGROUND

Field

Embodiments of the disclosure generally relate to ceramic resonator filters for radiofrequency components.

Description of the Related Art

Conventional resonators for ceramic filters have lengths that are dictated by the dielectric constant used in the material. Thus, conventional resonator filters can only achieved a proper electrical response at the expense of a larger size which can consume valuable printed circuit board (PCB) space.

SUMMARY OF THE INVENTION

Disclosed herein are embodiments of a radiofrequency filter comprising at least one stepped impedance resonator, the at least one stepped impedance resonator having a generally constant outer diameter, and a cavity passing through a length of the at least one stepped impedance resonator defining an inner diameter, the inner diameter having a first end and a second end, the first and second ends having a different diameter, the first end being larger than the second end.

In some embodiments, the inner diameter can be tapered from the first end to the second end. In some embodiments, the inner diameter is not tapered.

In some embodiments, the inner diameter can have a generally stair stepped profile between the first and second ends. In some embodiments, the stair stepped profile can include a single stair step feature that is generally equidistant from the first and second ends. In some embodiments, the stair stepped profile can include a plurality of stair step features between the first and second ends. In some embodiments, the inner diameter can taper in a middle portion between the first and second ends.

In some embodiments, the at least one stepped impedance resonator can have a resonance frequency falling in the range of 300 MHZ to 7 GHZ. In some embodiments, the impedance of the first end can be lower than the impedance of the second end. In some embodiments, the Q value of the at least one stepped impedance resonator can be within 10% of that of a resonator having a straight inner diameter.

In some embodiments, the filter can further comprise a plurality of stepped impedance resonators.

Also disclosed herein is a method for filtering a radiofrequency signal comprising: inputting a radiofrequency signal into a stepped impedance resonator having an outer diameter and a cavity through a length of the stepped impedance resonator to form an inner diameter, the inner diameter having a first end and a second end, the first and second ends having a different diameter, the first end being larger than the second end, and outputting the filtered radiofrequency signal.

Also disclosed herein is a radiofrequency device comprising at least one stepped impedance resonator, the at least one stepped impedance resonator having a generally constant outer diameter and a cavity passing through a length of the at least one stepped impedance resonator defining an inner diameter, the inner diameter having a first end and a second end, the first and second ends having a different diameter, the first end being larger than the second end.

In some embodiments, the inner diameter can be tapered from the first end to the second end. In some embodiments, the inner diameter is not tapered.

In some embodiments, the inner diameter can have a generally stair stepped profile between the first and second ends. In some embodiments, the stair stepped profile can include a single stair step feature that is generally equidistant from the first and second ends. In some embodiments, the stair stepped profile can include a plurality of stair step features between the first and second ends. In some embodiments, the inner diameter can taper in a middle portion between the first and second ends.

In some embodiments, the at least one stepped impedance resonator can have a resonance frequency falling in the range of 300 MHZ to 7 GHZ. In some embodiments, the impedance of the first end can be lower than the impedance of the second end. In some embodiments, the Q value of the at least one stepped impedance resonator can be within 10% of that of a resonator having a straight inner diameter.

In some embodiments, the device can further comprise a plurality of stepped impedance resonators.

Also disclosed herein are embodiments of a ceramic radiofrequency filter comprising a plurality of ceramic coaxial stepped impedance resonators mounted on a printed circuit board, each of the ceramic coaxial stepped impedance resonators having two ends at least one end of which is metallized, a length extending between the two ends, an outer diameter that is generally constant along the length, and a cavity extending along at least a portion of the length and defining an inner diameter and having first and second ends with different diameters, an input tab configured to input an RF signal, the input tab located at a first one of the plurality of ceramic coaxial stepped impedance resonators, an output tab configured to output a filtered RF signal, the output located at a ceramic coaxial stepped impedance resonator located farthest from the first one of the plurality of ceramic coaxial stepped impedance resonators, and coupling slot pairs located between adjacent ceramic coaxial stepped impedance resonators.

In some embodiments, the inner diameter can be tapered from the first end to the second end. In some embodiments, the inner diameter can have no tapers. In some embodiments, the inner diameter can have a generally stair stepped profile between the first and second ends. In some embodiments, the inner diameter can taper in a middle portion between the first and second ends.

In some embodiments, the at least one stepped impedance resonator can have a resonance falling in the range of 300 MHZ to 7 GHZ. In some embodiments, the impedance of the first end can be lower than the impedance of the second end. In some embodiments, the Q value of the at least one stepped impedance resonator can be within 10% of that of a resonator having a straight inner diameter.

Also disclosed herein are embodiments of a method for filtering a radiofrequency signal comprising inputting a radiofrequency signal into a ceramic filter having a plurality of ceramic coaxial stepped impedance resonators mounted on a printed circuit board, each of the ceramic coaxial stepped impedance resonators having two ends at least one of which is metallized, a length extending between the two ends, an outer diameter that is generally constant along the length, and a cavity extending along at least a portion of the length and defining an inner diameter and having first and second ends with different diameters, and outputting the filtered radiofrequency signal. In some embodiments, the inner diameter can have a generally stair stepped profile between the first and second ends.

Also disclosed herein are embodiments of a radiofrequency device comprising a plurality of ceramic coaxial stepped impedance resonators mounted on a printed circuit board forming a ceramic filter, each of the ceramic coaxial stepped impedance resonators having two ends at least one of which is metallized, a length extending between the two ends, an outer diameter that is generally constant along the length, and a cavity extending along at least a portion of the length and defining an inner diameter and having first and second ends with different diameters, an input tab configured to input an RF signal, the input tab located at a first of the plurality of ceramic coaxial stepped impedance resonators, an output tab configured to output a filtered RF signal, the output located at a ceramic coaxial stepped impedance resonator located farthest from the first of the plurality of ceramic coaxial stepped impedance resonators, and coupling slot pairs located between adjacent ceramic coaxial stepped impedance resonators.

In some embodiments, the inner diameter can be tapered from the first end to the second end. In some embodiments, the inner diameter may not be tapered. In some embodiments, the inner diameter can have a generally stair stepped profile between the first and second ends. In some embodiments, the stair stepped profile can include a single stair step feature that is generally equidistant from the first and second ends. In some embodiments, the stair stepped profile can include a plurality of stair step features between the first and second ends. In some embodiments, the inner diameter can taper in a middle portion between the first and second ends.

In some embodiments, at least one of the plurality of ceramic coaxial stepped impedance resonators can have a resonance frequency falling in the range of 300 MHZ to 7 GHZ. In some embodiments, the impedance of the first end can be lower than the impedance of the second end. In some embodiments, the Q value of at least one of the plurality of ceramic coaxial stepped impedance resonators can be within 10% of that of a resonator having a straight inner diameter.

DETAILED DESCRIPTION OF THE INVENTION

Disclosed herein are embodiments of filters using stepped impedance resonators in order to filter signals, such as radiofrequency or electronic signals. Specifically, the stepped impedance resonators can be advantageously used in a specific type of filter, known as a ceramic filter. Ceramic filters can include the use of ceramic resonators, specifically those ceramic stepped impedance resonators disclosed herein.

In some embodiments, the disclosed ceramic filters can be used in the megahertz to gigahertz frequency ranges, such as those used in broadcast radio, television, cellphones, or Wi-Fi. However, the specific frequency and use of the ceramic filter is not limiting. Further, the type of signal is not limiting and different signals can be understood to be passed through the filter. Thus, the disclosed ceramic filters can be, for example, ceramic radiofrequency or microwave filters, though the type of filter is not limiting.

Embodiments of the disclosed ceramic stepped impedance resonator filters can be advantageous for miniaturization as they can maintain adequate electrical properties even in the reduced sized, thereby reducing the overall footprint of the ceramic filter. In some embodiments, the ceramic stepped impedance resonator filters can have increased electrical properties over conventional filters. Further, embodiments of the disclosed ceramic stepped impedance resonator filters can avoid the manufacturing tolerance issues that currently affect conventional filters.

Ceramic Stepped Impedance Resonators

In some embodiments, ceramic stepped impedance resonators can be used in conjunction with radiofrequency (RF) filters. Embodiments of such ceramic stepped impedance resonators are described in detail below. Advantageously, ceramic stepped impedance resonator filters, and the devices they are incorporated into, can be further miniaturized over what was done in with conventional impedance resonators.

Figure 1A:
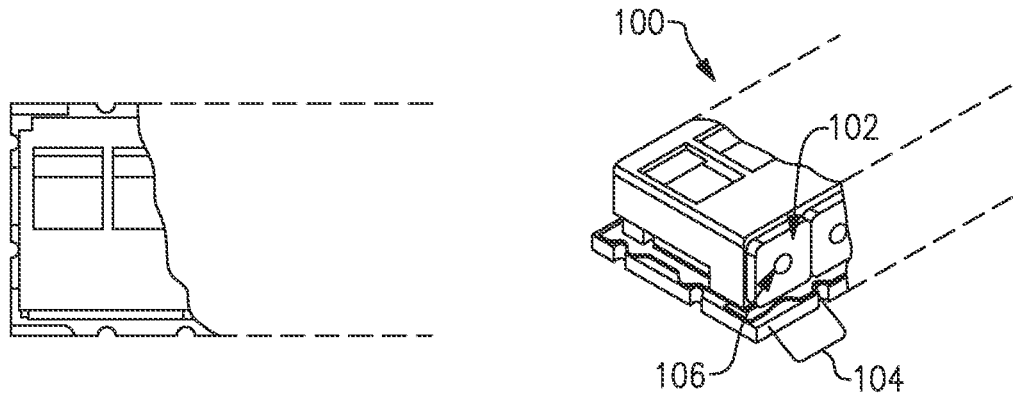
FIGS. 1A-1C illustrates viewpoints of an embodiment of a ceramic filter assembly incorporating stepped impedance resonators.
Figure 1B:
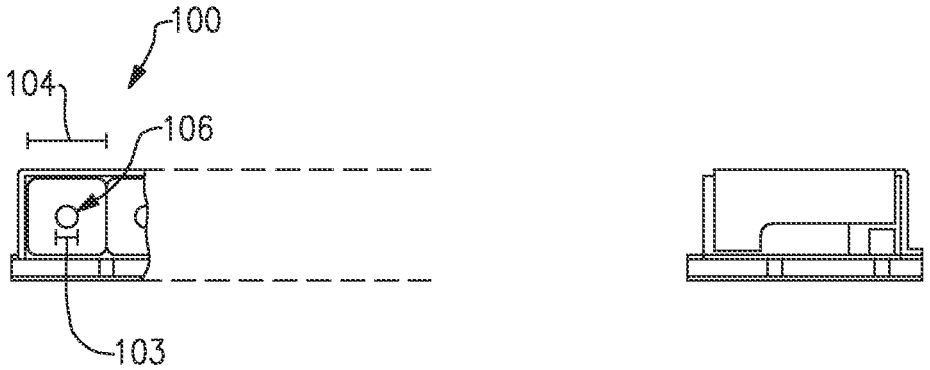
Figure 1C:
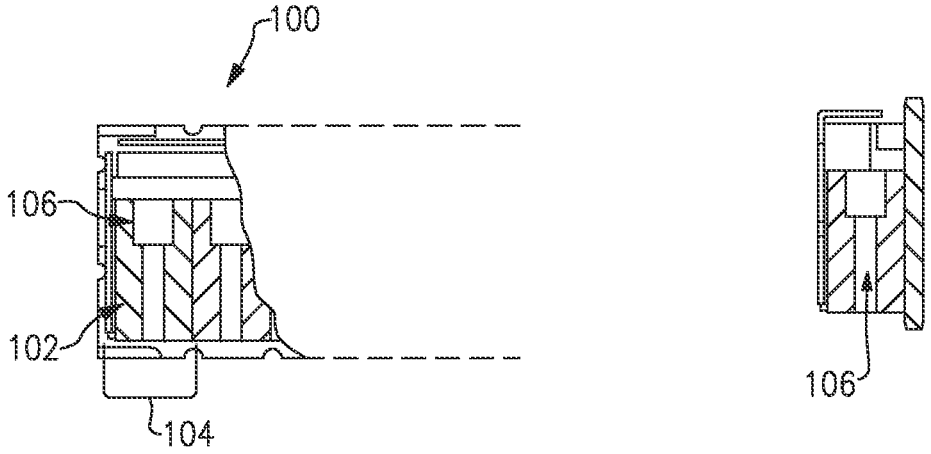

FIGS. 1A-1C illustrate an embodiment of a ceramic filter assembly 100 using a combination of resonators 102 (FIGS. 1A and 1C), such as stepped impedance resonators. As shown, in some embodiments, the resonator 102 can have a cavity, hole, aperture, or line 106 pass generally through the center of the resonator 102. In some embodiments, the cavity 106 can pass completely through the resonator 102. Accordingly, the resonator 102 has an outer diameter 104 and an inner diameter 103 (FIG. 1B), e.g. the diameter caused by the cavity 106 through the resonator 102.

As shown in FIGS. 1A-1C, the resonator 102 can have a generally constant outer diameter 104 (e.g. the overall width of the resonator 102). As shown, the resonators 102 can be generally rectangular, and as shown in FIG. 1B the face of the resonator 102 can generally be made of four equally sized segments, though the specific dimensions and shape of the resonators 102 is not limiting. Further, as shown in the cross-sectional views of FIG. 1C, the resonator 102 can have a varying inner diameter 103, thus leading to the resonator 102 having stepped (or variable) impedance for reasons discussed below. As shown, the inner diameter 103 can vary in shape along the length of the resonator 102 from one end to the other end. Thus, the inner diameter 103 can be larger at one end as compared to the other end.

In some embodiments, the ceramic filter assembly 100 can have a plurality of stepped impedance resonators 102, and the number of resonators 102 is not limiting. In some embodiments, the resonators 102 can be aligned as shown in FIGS. 1A-1C, or as discussed in detail throughout the disclosure.

A group of ceramic coaxial resonators 102 as described herein can be assembled together so as to be RF coupled and function as an RF filter, though the particular material is not limiting. These coaxial resonators can incorporate the stepped impedance resonators discussed in detail below, thus allowing for improved miniaturization. In some embodiments, the resonators 102 can be electrically coupled together, such as through electrical connections. Therefore, the unloaded quality factor of the resonators can be used to generally set the selectivity of the total ceramic filter assembly 100 itself. The resonators 102 can be coupled to one another through, for example, gap or capacitance coupling, or magnetic coupling. In some embodiments, such coupling of RF energy between two adjacent resonators can be achieved by slots formed on the facing surfaces of the two resonators. A width dimension of such a slot can be approximately proportional to a coupling constant within a range. If the slots have widths outside of such a range, electrical performance of the ceramic filter can be degraded. The type and method of coupling between resonators 102 is not limiting.

Figure 2:
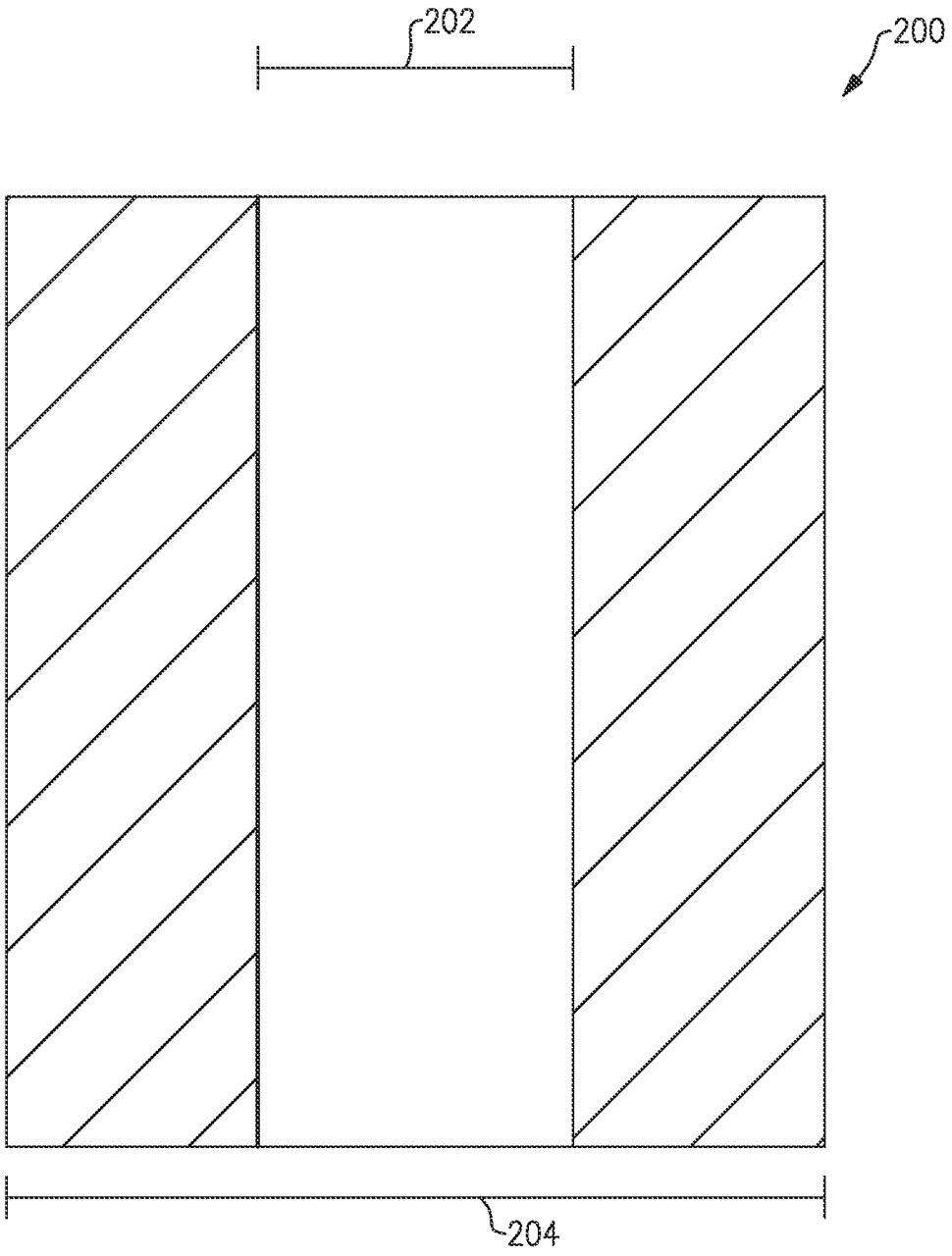
FIG.2 Prior Art
FIG. 2 illustrates an inner diameter of a resonator used in the prior art.

In typical resonators of the prior art, as shown in FIG. 2, the inner diameter 202 and outer diameter 204 of the resonator 200 is required to be straight and homogenous. While this structure may be relatively simple to manufacture, due to its simple design, it has become exceedingly difficult to miniaturize these straight inner diameters.

Currently, due to the nature of miniaturization, straight inner diameters are at the bounds of tolerance for formation. This tolerance bound occurs because as the size of the resonator is reduced, the inner diameter and outer diameter become closer to one another, eventually getting to the point where the ratio between the two is so close that current manufacturing techniques cannot properly form the resonator. If the conventional inner diameters were to miniaturized past what they are currently sized, it would be nearly impossible to maintain a precise and proper electrical response.

Thus, conventional ceramic filters of the prior art can achieve the proper electrical response (e.g., Q, impedance) only at the expense of a larger size, which consumes valuable space in the radiofrequency filter or device. Accordingly, a limited number of ceramic filters can be used in typical applications due to space constraints.

Another method of miniaturizing the resonators used in the art is to increase the dielectric constant of the resonator material. However, again, current productions of materials has a limited maximum dielectric constant, and thus other methods to continue to miniaturize the filters are needed in order to continue the miniaturization of the resonators.

Disclosed are embodiments of stepped impedance resonators which can be used to advantageously continue miniaturization of resonators. Unlike the straight inner diameters used in the prior art shown in FIG. 2, stepped impedance resonators can be composed of inner diameters having varying dimensions. These varying dimensions can allow the resonator to maintain low impedance values overall while at the same time allow for the resonator, and thus the filter, to be further miniaturized. For embodiments of the disclosed stepped impedance resonators, the same electrical response can be achieved as that of the prior art with a significantly smaller footprint and with minimal to no negative effects to the electrical response. This can be advantageous for the overall reduction of size of radiofrequency filters.

FIGS. 3A-3E illustrate cross-sectional views of different non-limiting configurations of the inner diameters, and thus inner cavities, for embodiments of a stepped impedance resonator which can be used advantageously with ceramic filters. While a cross section of the inner diameters are shown, the inner diameters themselves can be planar or three-dimensional, such as generally cylindrical inner diameters, or the diameters shown can extend generally straight upwards to create a three-dimensional shape having the shown footprint. The overall dimensions of the inner diameters are not limiting. Further, as shown in FIGS. 3A-3E, the outer diameter 303 can be generally the same throughout, though the particular dimensions of the outer diameter 303 is not limiting. In some embodiments, a cap can be placed over the end of the ceramic stepped impedance resonators to reduce or increase the inner diameter so that the cavity extending outside can have the same diameter. In some embodiments, the disclosed inner diameters changes can be shorter than the length of the resonator, and the inner diameter can transition to a similar diameter at both ends.

Figure 3A:
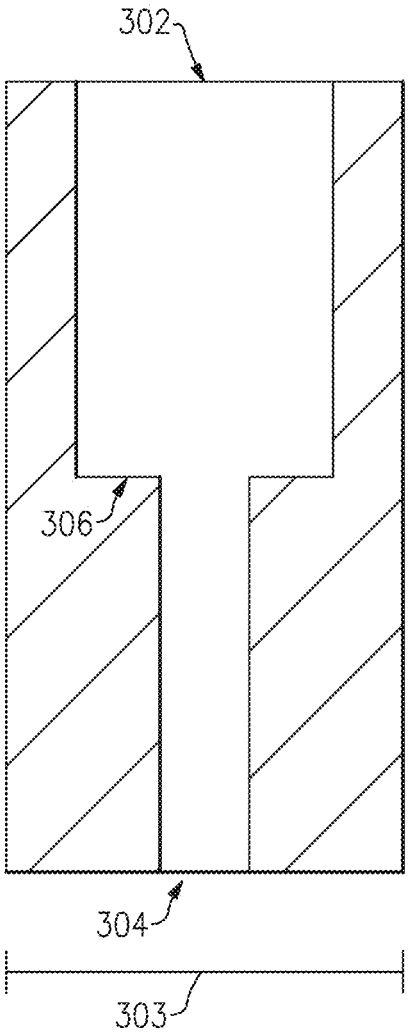
FIGS. 3A-3D illustrate embodiments of a variable inner diameter for a ceramic stepped impedance resonator filter.

As shown in FIG. 3A, the inner diameters can start with a larger inner diameter 302 and end in a smaller inner diameter 304. Between the two ends, the inner diameter 304 can reduce in diameter at a pair of 90° turns 306, though the angle is not limiting and other angles can be used as well. Accordingly, the inner diameters can have a generally abrupt transition from the larger diameter to the smaller diameter.

The transition can occur generally in the middle of the inner diameters, as shown in FIG. 3A, though it can be located in other locations as well and the location of the transition is not limiting. In some embodiments, about 50% of the inner diameters can be the larger diameter and about 50% of the inner diameters can be the smaller diameter. In some embodiments, the ratio can be 90/10, 80/20, 70/30, 60/40, 40/60, 30/70, 20/80, or 10/90.

Figure 3B:
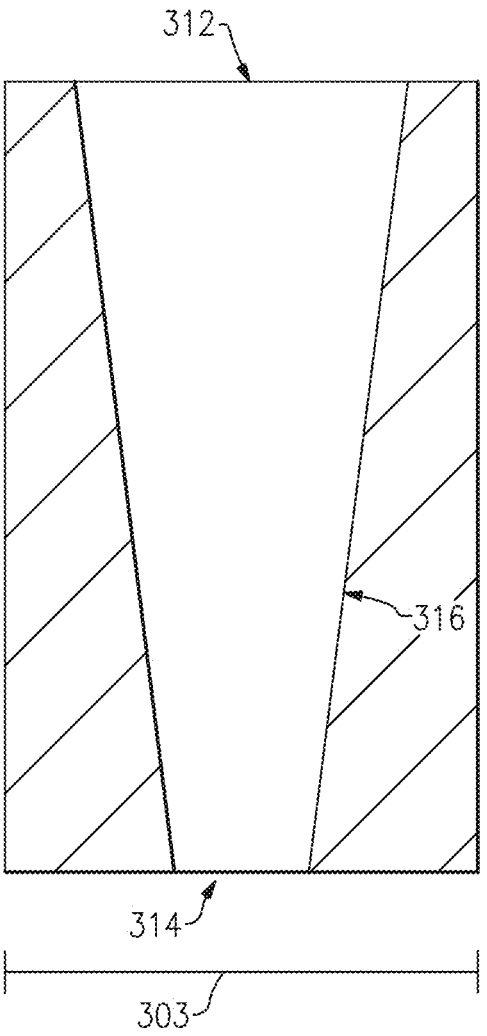

FIG. 3B shows an embodiment of an inner diameter that can have a generally tapered reduction in diameter from a large end 312 to a smaller end 314. In some embodiments, the inner diameter can form a generally conical cavity within the resonator. As shown, the taper 316 can extend along the length of the inner diameters. The taper can be generally straight, as shown in FIG. 3B, or can be at least partially curved.

Figure 3E:
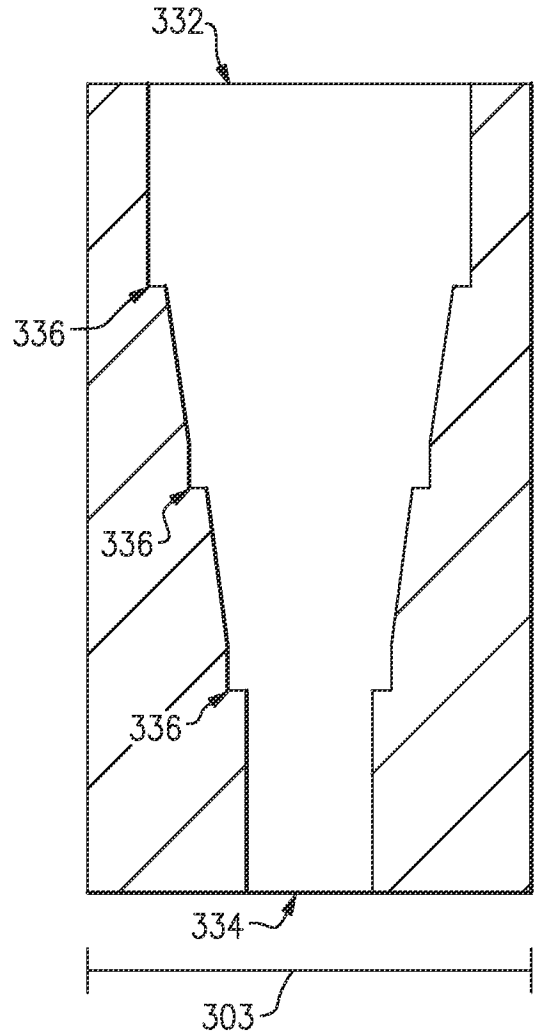
Figure 3D:
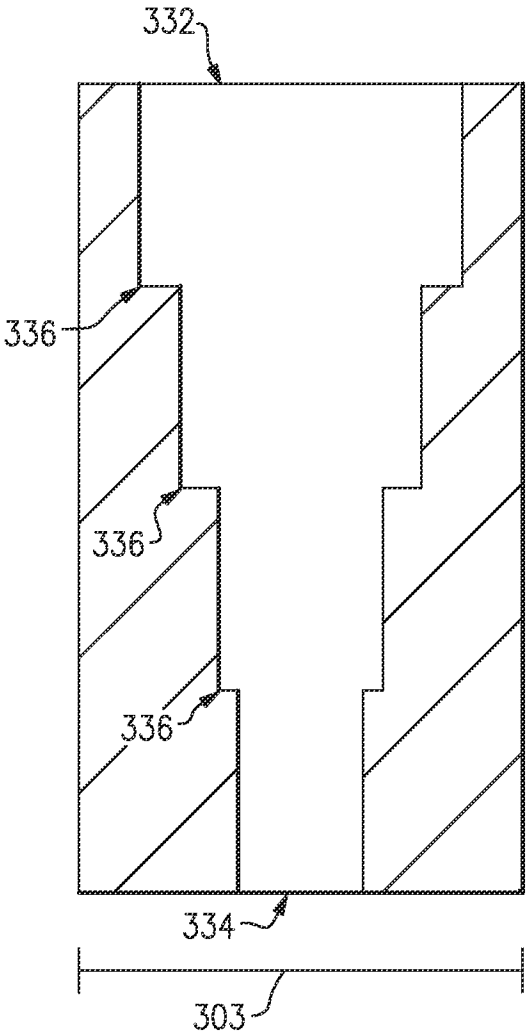
Figure 3C:
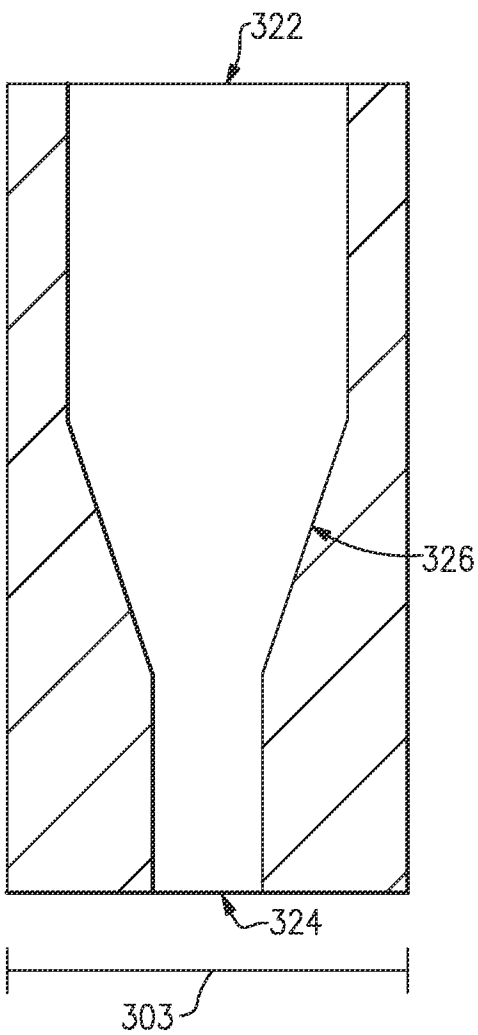

FIG. 3C shows an embodiment of an inner diameter similar to that shown in FIG. 3B. However, as shown, the taper occurs at a much higher rate and does not extend the length of the inner diameter. For example, the larger diameter section 322 extends partially down the inner diameter. The inner diameter then tapers (shown by taper 326) until it reaches a smaller diameter section 324, which extends outwards. In some embodiments, the taper may occur starting at the small or larger ends, and thus there may be only one tapered section and one straight section. All tapers between FIG. 3B and FIG. 3C can be used as well, and the size and slope of the taper is not limiting.

FIG. 3D shows an embodiment of an inner diameter that can have a generally stair-step structure. As shown, the inner diameter can decrease from a maximum diameter 332 to a minimum diameter 334 in a series of progressive steps 336. In some embodiments, a series of progressive tapers can be used instead of steps. In some embodiments, both tapers and steps 336 can be used to reduce the diameter of the inner diameter from a maximum diameter 332 to a minimum diameter 334 such as shown in FIG. 3E. The steps 336 can be approximately the same size or different sizes. In some embodiments, the steps 336 can be tapered or angled.

In some embodiments, a shortened end of a resonator can be interchanged from the open end. For example, the smaller diameter can be on either end of the resonator, and it is not limited to a particular configuration. By switching the short and open end, this can give an opposite effect on frequency vs. length, and can provide some further advantageous properties.

Embodiments of the disclosed tapered inner diameters can be advantageous for the miniaturization of ceramic resonators, and thus ceramic radiofrequency filters. Generally, the larger the inner diameter of the resonator, the lower the impedance of the resonator. A lower impedance means that the ceramic filter will be able to more efficiently filter out the signals. However, a larger diameter typically reduces the resonance of the resonator, which can be disadvantageous to ceramic filters. Therefore, a smaller inner diameter can improve the ceramic filter's resonance, though as mentioned above increases impedance. Further, by having a smaller diameter for at least part of the resonator, this can avoid some of the tolerance issues of the prior art for miniaturization.

Thus, by having the transition from the larger to smaller diameters, the low impedance of the larger diameter portion can be maintained, while the greater resonance at the smaller diameter line can be achieved. This affect follows the transmission line theory. Therefore, low impedance and high resonance can be maintained for the ceramic stepped impedance resonator filters. Accordingly, embodiments of the disclosure can advantageously have high efficiency and high resonance. In resonators of the prior art, the two different properties must be balanced with one another, making it difficult to achieve a high resonance and high efficiency resonator.

In some embodiments, there is minimal Q degradation when using a stepped impedance resonator as compared to a conventional resonator such as shown in FIG. 2. For example, the Q degradation can be less than about 20%, less than about 10%, less than about 5%, less than about 1%, or 0% as compared to a conventional straight resonator.

In some embodiments, the overall footprint of the ceramic filter using stepped impedance resonators is about 20% to about 30% less than that of a ceramic filter using a conventional resonator, such as shown in FIG. 2.

In some embodiments, the stepped impedance resonator filters can have a length of approximately 110-140 thousandths of an inch, which is significantly less than that of the conventional filters using conventional inner diameters. In some embodiments, the ceramic stepped impedance resonator filters can have a length of less than approximately 110-140 thousandths of an inch.

In some embodiments, the inner diameters discussed above can range from about 0.05, 0.10, 0.15, 0.20, or 0.25 to about 0.35, 0.40, 0.45, or 0.50 inches for a 0.062 outer diameter, though the exact dimensions are not limiting.

In some embodiments, the stepped impedance resonator can have a resonance frequency between about 100 MHZ and about 20 GHZ. In some embodiments, the resonator can have a resonance frequency of between about 300 MHZ and about 5 GHZ. In some embodiments, the stepped impedance resonator can have a resonance frequency greater than about 100 MHZ, 300 MHZ, 500 MHZ, 1 GHZ, 5 GHZ, 10 GHZ, or 20 GHZ. The resonance frequency of the stepped impedance resonator is not limiting.

In some embodiments, the stepped impedance resonator can have a bandwidth from 2 to 25 percent. In some embodiments, the stepped impedance resonator can have a bandwidth greater than 2, 5, 10, 15, or 20 percent. In some embodiments, the stepped impedance resonator can have a bandwidth less than 25, 20, 15, 10, or 5 percent.

Filter Grouping

Figure 4A:
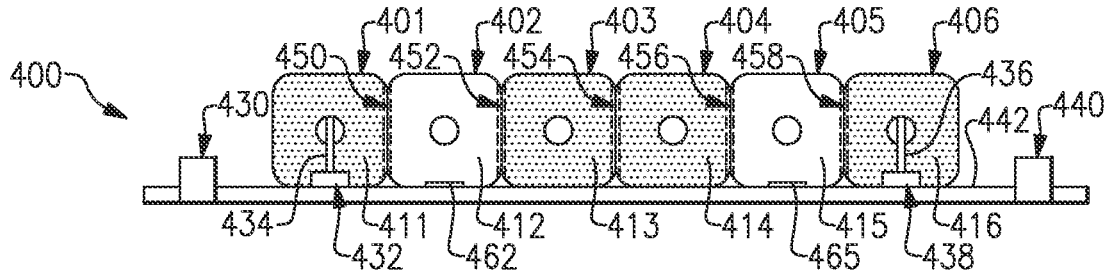
FIGS. 4A-4C illustrate an embodiment of an example radio-frequency ceramic filter having selected interdigitation of coaxial resonators.
Figure 4B:
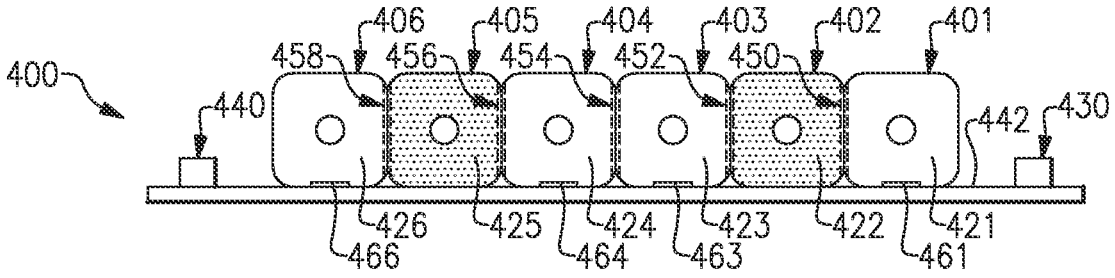
Figure 4C:
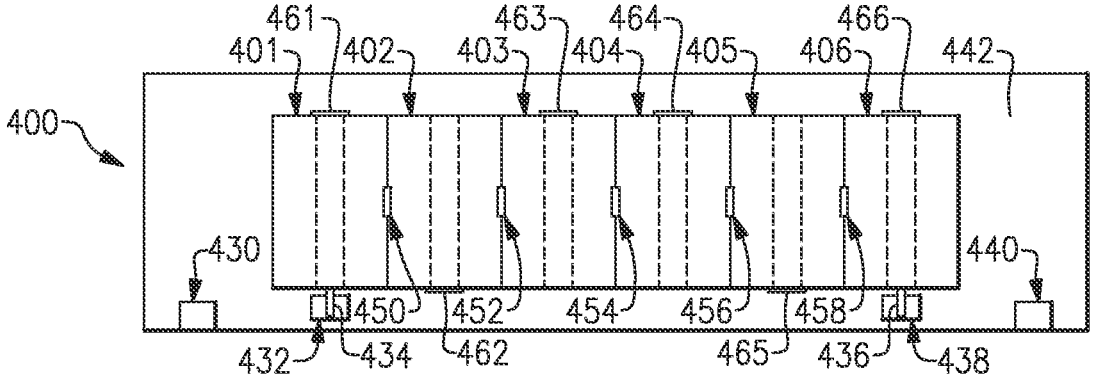

FIGS. 4A-4C show various views of an example ceramic RF filter 400 having six ceramic coaxial resonators (401, 402, 403, 404, 405, 406) arranged in a manner as described herein. In particular, the ceramic RF filters shown in FIGS. 4A-4C can save space on the PCB, especially as they can be further miniaturized from filters known in the prior art through the use of stepped impedance resonators. While FIGS. 4A-4C show cavities having the same size on both end, it will be understood that the ceramic stepped impedance resistors can be used and thus the cavities shown may not be to scale. FIG. 4A shows a front side view, FIG. 4B shows a back side view, and FIG. 4C shows a plan view of the example ceramic filter 400. As described herein, ceramic RF filters having one or more features associated with the example ceramic filter 400 can include other numbers of ceramic coaxial resonators, such as stepped impedance resonators discussed above.

The six resonators (401-406) are shown to be mounted on a PCB substrate 442 and arranged so as to be RF coupled via coupling slot pairs indicated as 450, 452, 454, 456, 458. The six resonators are also shown to have front ends 411, 412, 413, 414, 415, 416 (FIG. 4A) and back ends 421, 422, 423, 424, 425, 426 (FIG. 4B). An input tab 434 for providing an input RF signal is shown to be positioned at the front end 411 of the first resonator 401, and an output tab 436 for outputting a filtered RF signal is shown to be positioned at the front end 416 of the sixth resonator 406. The input tab 434 (FIGS. 4A and 4C) is electrically connected to a capacitor 432 (FIGS. 4A and 4C) which is in turn electrically connected to an input connector 430. Similarly, the output tab 436 (FIGS. 4A and 4C) is electrically connected to a capacitor 438 (FIGS. 4A and 4C) which is in turn electrically connected to an output connector 440.

In FIGS. 4A and 4B, a metalized end of a resonator is depicted as being un-shaded, and a metalized end is depicted as being shaded. Accordingly, the front ends 411, 413, 414, 416 as shown in FIG. 4A corresponding to the first (401), third (403), fourth (404) and sixth (406) resonators are non-metalized, and the remaining front ends 412, 415 corresponding to the second (402) and fifth (405) resonators are metalized. The back ends 421, 423, 424, 426 as shown in FIG. 4B corresponding to the first (401), third (403), fourth (404) and sixth (406) resonators are metalized, and the remaining back ends 422, 425 corresponding to the second (402) and fifth (405) resonators are non-metalized. Accordingly, each of the six resonators can operate as a quarter-wave resonator. Each of the metalized front and back ends of the foregoing example is connected to a ground. Such ground connections are depicted in FIGS. 4A-4C by connections 461 (FIGS. 4B, 4C), 462 (FIGS. 4A, 4C), 463 (FIGS. 4B, 4C), 464 (FIGS. 4B, 4C), 465 (FIGS. 4A, 4C), 466 (FIGS. 4B, 4C). However, other configurations can be used and the particular configuration of the group of resonators is not limiting.

It is noted that in the foregoing example, the first, third, fourth and sixth resonators are in a first orientation with their front ends facing the front side where the input and output connectors (430, 440) are, and the second and fifth resonators are in a second orientation with their back ends facing the front side. Accordingly, the second resonator 402 is in an interdigitated configuration between the first and third resonators 401, 403. Similarly, the fifth resonator 405 is interdigitated between the fourth and sixth resonators 404, 406. It is noted that a sub-group of the third, fourth and fifth resonators are all in the first orientation so as to be in a comb-line configuration. Based on the foregoing example, one can see that the resonators in the ceramic filter 400 have selected interdigitation of resonator orientations. For the purpose of description herein, it will be understood that a "full interdigitation" configuration has all of the resonators in alternating orientations. Further, "selected interdigitation" or simply "interdigitation" as described herein includes non-full interdigitation configurations having some alternating orientations of the resonators.

As applied to the example of FIGS. 4A-4C, the selected interdigitation allows both of the input and output of the ceramic filter 400 to be maintained at a common reference plane (e.g., front side) of the ceramic filter 400 using an even number of resonators. For a full interdigitation configuration, an even number of resonators will result in the input and output to be on the opposite sides. While it is possible to route one of the two (input and output) to the other side so as to have both connectable on the same side, the extra connection length can impact the electrical property of the ceramic filter (e.g., by undesirably changing the inductance).

Ceramic Filters Types

Ceramic filters types can be broken into four general categories, though the categories themselves are not limiting. For example, the filters can be band-pass filters, band-stop filters, low-pass filters, or high-pass filters. Embodiments of the disclosed stepped impedance filters discussed in detail above can be incorporated in any category of filters, and can provide for advantageous miniaturization for any category of filter.

Band-pass filters can be used to selectively obtain a desired band of frequencies, while excluding undesired frequencies. Generally, the band-pass filter can pass frequencies within a certain range and reject, or attenuate, frequencies outside of that range. In particular, band-pass filters can be used in wireless transmitters and receivers. In a transmitter, the band-pass filter can limit the bandwidth of the output signal to the band allocated for transmission. This can reduce interference with other stations, thus improving the quality of the signal transmitted. In a receiver, the band-pass filter can allow for signals within a selected range of frequencies to be heard or decoded, and can prevent signals outside of the selected range from getting through. In some embodiments, a band-pass filter can optimize signal-to-noise ratio and sensitivity of a receiver. The band-pass filter can optimize the mode and speed of signal being used while maximizing the number of signals being used, and at the same time minimizing interference or competition among signals.

Band-stop filters are generally opposite of band-pass filters, in that they pass most frequencies unaltered but attenuate those in a specific range of frequencies. These can be used, for example, to reduce feedback. However, band-stop filters are typically less common in the electronics field.

Low-pass filters are filters that pass low-frequency signals and attenuate signals higher than a specified cutoff frequency. Attenuation and cut off frequency can be adjusted in the low-pass filters. Low-pass filters can be used for numerous products, such as electronic circuits, analog-to-digital converters, digital filters.

High-pass filters are generally the opposite of low-pass filters. High-pass filters pass high-frequency signals and attenuate signals lower than a specified cutoff frequency. Attenuation and cut off frequency can be adjusted in the high-pass filters. High-pass filters can be used, for example, for blocking DC from circuitry. The combination of high and low pass filters can form a band pass filter, as described above.

Applications of Ceramic Stepped Impedance Filters

Figure 5:
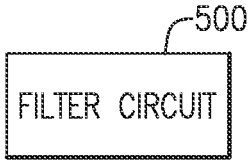
FIG. 5 schematically shows that one or more features of the present disclosure can be implemented as a ceramic filter circuit.
Figure 6:
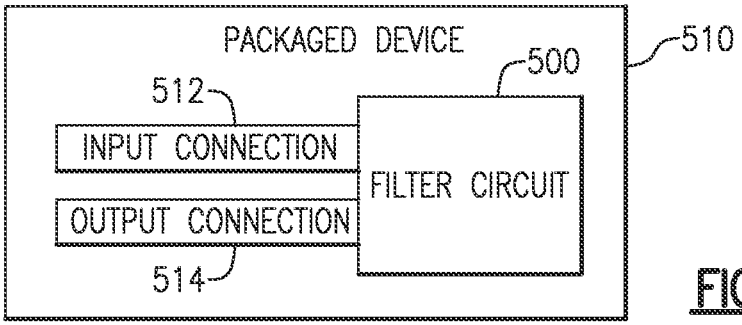
FIG. 6 shows that the ceramic filter circuit of FIG. 5 can be implemented in a packaged device.

FIG. 5 schematically shows that embodiments of the ceramic stepped impedance resonant filters can be implemented as a ceramic filter circuit 500. Such a ceramic filter circuit can be implemented in a number of products, devices, and/or systems. For example, FIG. 6 shows that in some embodiments, a packaged device 510 can include a ceramic filter circuit 500 configured to be coupled to input and output connections 512, 514 on a same side and provide performance features as described herein. Such a packaged device 510 in FIG. 5 can be a dedicated ceramic RF filter module, or include some other functional components.

Figure 7:
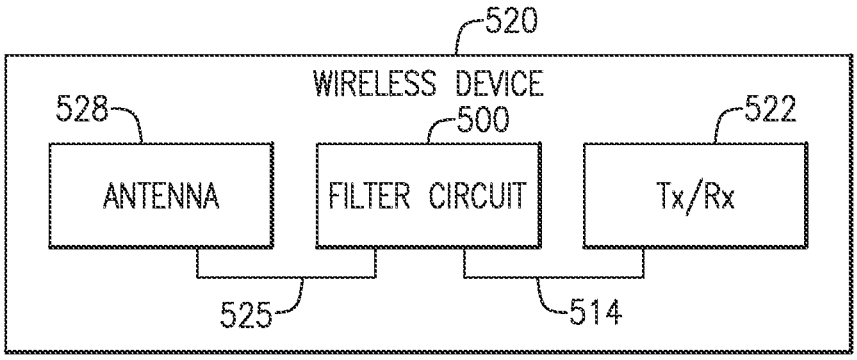
FIG. 7 shows that the ceramic filter circuit of FIG. 5 can be implemented in a wireless device.

FIG. 7 shows that in some embodiments, a ceramic filter circuit 500 can be implemented in a wireless device 520. Such a wireless device can include an antenna 528 in communication with the ceramic filter circuit (line 525). The wireless device 520 can further include a circuit 522 configured to provide transmit (Tx) and/or receive (Rx) functionalities. The Tx/Rx circuit 522 is shown to be in communication with the ceramic filter circuit 500 (line 514).

Figure 8:
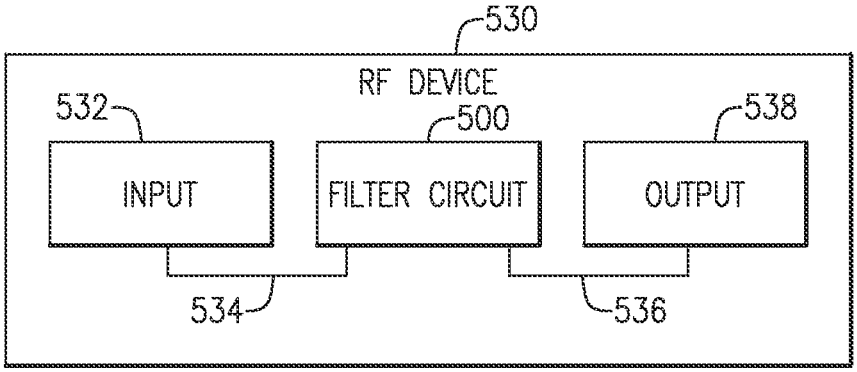
FIG. 8 shows that the ceramic filter circuit of FIG. 5 can be implemented in a wire-based of wireless RF device.

FIG. 8 shows that in some embodiments, a ceramic filter circuit 500 can be implemented in an RF device 530. Such a device can include an input component 532 that provides an input RF signal to the ceramic filter circuit (line 534), and an output component 538 that receives a filtered RF signal from the ceramic filter circuit 500 (line 536). The RF device 530 can be a wireless device such as the example of FIG. 7, a wire-based device, or some combination thereof.

In some implementations, ceramic RF filters having one or more band pass filtering features as described herein can be utilized in a number of applications involving systems and devices. Such applications can include but are not limited to cable television (CATV); wireless control system (WCS); microwave distribution system (MDS); industrial, scientific and medical (ISM); cellular systems such as PCS (personal communication service), digital cellular system (DCS) and universal mobile communications system (UMTS); and global positioning system (GPS).

Figure 9:
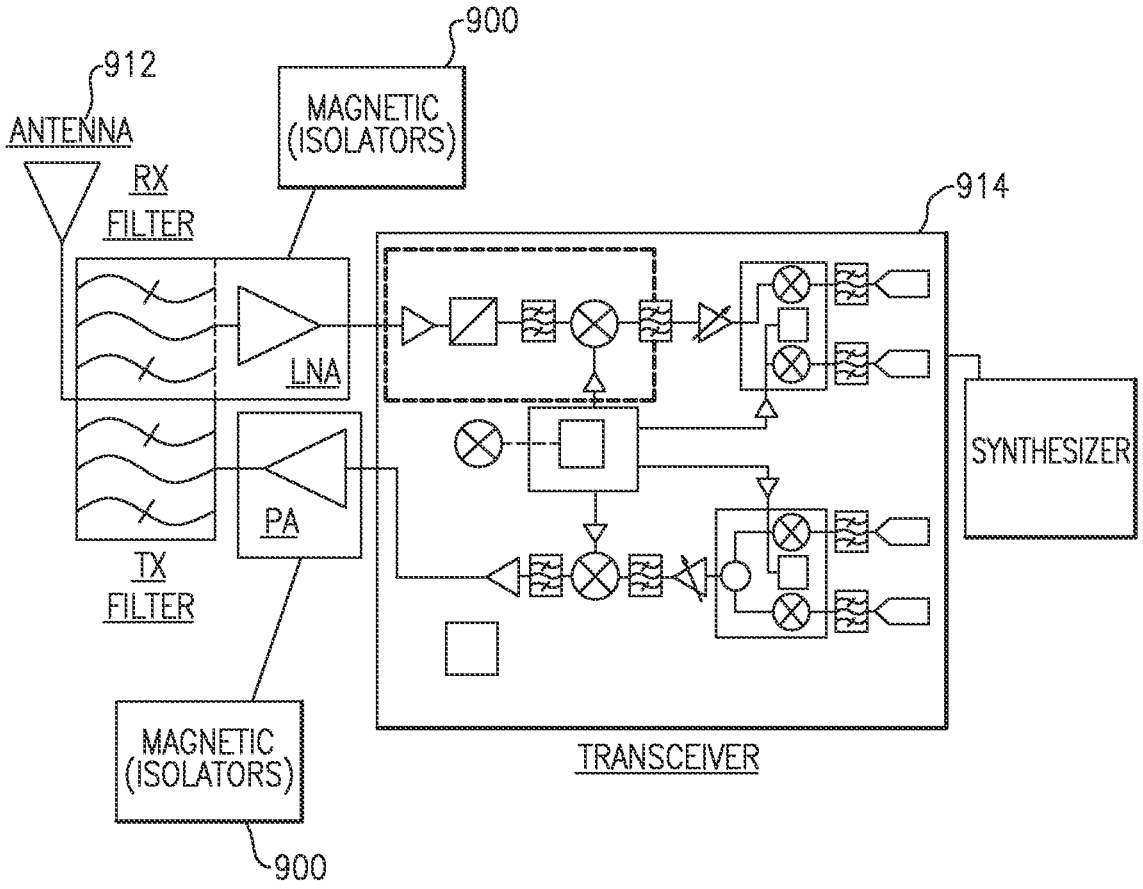
FIG. 9 illustrates a radiofrequency device including an embodiment of a ceramic stepped impedance resonator filter.

Further, in some embodiments, the disclosed ceramic stepped impedance resonator filter can be used with RF devices. As shown in FIG. 9, such an RF apparatus can include an antenna 912 that is configured to facilitate transmission and/or reception of RF signals. Such signals can be generated by and/or processed by a transceiver 914. For transmission, the transceiver 914 can generate a transmit signal that is amplified by a power amplifier (PA) and filtered (Tx Filter) for transmission by the antenna 912. For reception, a signal received from the antenna 912 can be filtered (Rx Filter) and amplified by a low-noise amplifier (LNA) before being passed on to the transceiver 914. In some embodiments, the ceramic filters shown in FIG. 9 can be an embodiment of a ceramic stepped impedance resonator filter as disclosed herein.

In some embodiments, ceramic stepped impedance resonator filters can be implemented in RF applications such as a wireless telecommunication base-station. Such a wireless base-station can include one or more antennas, such as the example described in reference to FIG. 9, configured to facilitate transmission and/or reception of RF signals. Such antenna(s) can be coupled to circuits and devices having one or more filters as described herein. In some embodiments, the base can have a transceiver 914, a synthesizer, an RX filter, a TX filter, magnetic isolators 900 and an antenna 912. The magnetic isolators 900 can be incorporated in a single channel PA and connectorized, integrated triplate or microstrip drop-in.

From the foregoing description, it will be appreciated that an inventive product and approaches for ceramic filters using stepped impedance resonators are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A ceramic radiofrequency filter comprising:

at least one ceramic coaxial stepped impedance resonator, the at least one ceramic coaxial stepped impedance resonator having two ends, at least one of the two ends being metallized, a length extending between the two ends, an outer diameter extending along the length, and a cavity having first and second ends and extending along at least a portion of the length, the cavity defining an inner diameter, the inner diameter decreasing from the first end of the cavity to the second end of the cavity through a plurality of tapers.

2. The ceramic radiofrequency filter of claim 1 wherein the at least one ceramic coaxial stepped impedance resonator has a resonance frequency falling in a range of 300 MHz to 7 GHz.

3. The ceramic radiofrequency filter of claim 1 wherein the at least one ceramic coaxial stepped impedance resonator includes a plurality of ceramic coaxial stepped impedance resonators.

4. The ceramic radiofrequency filter of claim 3 further including:

an input tab configured to input an radiofrequency signal, the input tab located at a first of the plurality of ceramic coaxial stepped impedance resonators; and an output tab configured to output a filtered radiofrequency signal, the output located at a second of the plurality of ceramic coaxial stepped impedance resonators that is located farthest from the first of the plurality of ceramic coaxial stepped impedance resonators.

5. The ceramic radiofrequency filter of claim 1 wherein the plurality of tapers includes a plurality of tapered steps.

6. The ceramic radiofrequency filter of claim 1 wherein the length of the at least one ceramic coaxial stepped impedance resonator is less than about 140 thousandths of an inch.

7. The ceramic radiofrequency filter of claim 1 wherein the at least one ceramic coaxial stepped impedance resonator is mounted on a printed circuit board.

8. A method for filtering a radiofrequency signal comprising:

inputting radiofrequency signal into a filter having at least one ceramic coaxial stepped impedance resonator, the at least one ceramic coaxial stepped impedance resonator having two ends, at least one of the two ends being metallized, a length extending between the two ends, an outer diameter extending along the length, and a cavity having first and second ends and extending along at least a portion of the length, the cavity defining an inner diameter decreasing from the first end of the cavity to the second end of the cavity through a plurality of tapers; and outputting the radiofrequency signal as a filtered radiofrequency signal.

9. The method of claim 8 wherein the at least one ceramic coaxial stepped impedance resonator has a resonance frequency falling in a range of 300 MHz to 7 GHz.

10. The method of claim 8 wherein the at least one ceramic coaxial stepped impedance resonator includes a plurality of ceramic coaxial stepped impedance resonators.

11. The method of claim 8 wherein the plurality of tapers includes a plurality of tapered steps.

12. The method of claim 8 wherein the length of the at least one ceramic coaxial stepped impedance resonator is less than about 140 thousandths of an inch.

13. The method of claim 8 further including mounting the at least one ceramic coaxial stepped impedance resonator on a printed circuit board.

14. A radiofrequency device comprising:

at least one ceramic coaxial stepped impedance resonator, the at least one ceramic coaxial stepped impedance resonator having two ends, at least one of the two ends being metallized, a length extending between the two ends, an outer diameter extending along the length, and a cavity having first and second ends and extending along at least a portion of the length, the cavity defining an inner diameter decreasing from the first end of the cavity to the second end of the cavity through a plurality tapers.

15. The radiofrequency device of claim 14 wherein the radiofrequency device is incorporated into a cellular system.

16. The radiofrequency device of claim 14 wherein the at least one ceramic coaxial stepped impedance resonator includes a plurality of ceramic coaxial stepped impedance resonators.

17. The radiofrequency device of claim 14 wherein the plurality tapers includes a plurality of tapered steps.

18. The radiofrequency device of claim 14 wherein the length of the at least one ceramic coaxial stepped impedance resonator is less than about 140 thousandths of an inch.

19. The radiofrequency device of claim 14 wherein the at least one ceramic coaxial stepped impedance resonator is mounted on a printed circuit board.

20. The radiofrequency device of claim 14 wherein the at least one ceramic coaxial stepped impedance resonator has a resonance frequency falling in a range of 300 MHz to 7 GHz.

* * * * *